US006474651B1

(12) United States Patent
Rivera

(10) Patent No.: US 6,474,651 B1
(45) Date of Patent: Nov. 5, 2002

(54) GAME

(76) Inventor: Rene Rivera, 4520 4th Ave. Apt N202, Brooklyn, NY (US) 11220

( * ) Notice: Subject to any disclaimer, the term of this patent is extended or adjusted under 35 U.S.C. 154(b) by 14 days.

(21) Appl. No.: 09/765,597

(22) Filed: Jan. 22, 2001

(51) Int. Cl.[7] ..... A63B 67/00; A63B 71/00; A63F 9/00

(52) U.S. Cl. ..... 273/342; 273/441

(58) Field of Search ..... 273/336, 342, 273/352, 381, 396, 398–401, 412, 441, 456; 473/164, 196, 510–513, 588, 592, 527

(56) References Cited

U.S. PATENT DOCUMENTS

| | | | | | |
|---|---|---|---|---|---|
| 1,292,011 | A | * | 1/1919 | Monroe | 473/588 |
| 2,432,824 | A | * | 12/1947 | Shelter | 273/399 |
| 3,368,814 | A | | 2/1968 | Kolwicz | |
| 3,731,930 | A | * | 5/1973 | Jeandron | 273/395 |
| 3,740,035 | A | | 6/1973 | Grossman | |
| 3,784,200 | A | * | 1/1974 | Hotchkiss | 273/353 |
| 3,837,648 | A | | 9/1974 | Breslow | |
| 4,293,132 | A | * | 10/1981 | Starr | 473/414 |
| 4,877,256 | A | | 10/1989 | Falloon | |
| 4,989,880 | A | * | 2/1991 | Gettemeier et al. | 273/400 |
| D341,381 | S | | 11/1993 | Niebling | |
| 5,316,302 | A | * | 5/1994 | Sedberry | 473/353 |
| 5,333,879 | A | * | 8/1994 | Barnes | 273/400 |
| 5,358,256 | A | * | 10/1994 | Kraemer | 273/401 |
| 5,368,306 | A | | 11/1994 | Madsen | |
| 5,472,211 | A | * | 12/1995 | McCaughan | 273/401 |

* cited by examiner

*Primary Examiner*—Paul T. Sewell
*Assistant Examiner*—Mitra Aryanpour

(57) ABSTRACT

A game for attempting to bounce a game piece into one of a plurality of cups. The game includes a game board having a top surface, a front edge, a back edge and a pair of side edges. A starting line extends between the side edges and is orientated generally parallel to the front edge. The starting line is positioned nearer the front edge than the back edge. A plurality of cups is positioned on the game board. A first and second of the cups is positioned generally between the starting line and the back edge. A third of the cups is positioned generally between the first and second cups and the front edge. A fourth and fifth of the cups is positioned between front edge and the third cup. A sixth of the cups is positioned between the fourth and fifth cups and the back edge. A game piece is elongated and has a pointed end. Players attempt the game piece on the board and into one of the cups.

9 Claims, 1 Drawing Sheet

GAME

BACKGROUND OF THE INVENTION

1. Field of the Invention

The present invention relates to games and more particularly pertains to a new game for attempting to bounce a game piece into one of a plurality of cups.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,837,648; 3,368,814; 3,740,035; 5,368,306; 4,877,256; and U.S. Patent No. Des. 341,381.

While these devices fulfill their respective, particular objectives and requirements, the aforementioned patents do not disclose a new game. The inventive device includes a game board having a top surface, a front edge, a back edge and a pair of side edges. A starting line extends between the side edges and is orientated generally parallel to the front edge. The starting line is positioned nearer the front edge than the back edge. A plurality of cups is positioned on the game board. A first and second of the cups is positioned generally between the starting line and the back edge. A third of the cups is positioned generally between the first and second cups and the front edge. A fourth and fifth of the cups is positioned between front edge and the third cup. A sixth of the cups is positioned between the fourth and fifth cups and the back edge. A game piece is elongated and has a pointed end. Players attempt the game piece on the board and into one of the cups.

In these respects, the game according to the present invention substantially departs from the conventional concepts and designs of the prior art, and in so doing provides an apparatus primarily developed for the purpose of attempting to bounce a game piece into one of a plurality of cups.

SUMMARY OF THE INVENTION

In view of the foregoing disadvantages inherent in the known types of games now present in the prior art, the present invention provides a new game construction wherein the same can be utilized for attempting to bounce a game piece into one of a plurality of cups.

The general purpose of the present invention, which will be described subsequently in greater detail, is to provide a new game apparatus and method which has many of the advantages of the games mentioned heretofore and many novel features that result in a new game which is not anticipated, rendered obvious, suggested, or even implied by any of the prior art games, either alone or in any combination thereof.

To attain this, the present invention generally comprises a game board having a top surface, a front edge, a back edge and a pair of side edges. A starting line extends between the side edges and is orientated generally parallel to the front edge. The starting line is positioned nearer the front edge than the back edge. A plurality of cups is positioned on the game board. A first and second of the cups is positioned generally between the starting line and the back edge. A third of the cups is positioned generally between the first and second cups and the front edge. A fourth and fifth of the cups is positioned between front edge and the third cup. A sixth of the cups is positioned between the fourth and fifth cups and the back edge. A game piece is elongated and has a pointed end. Players attempt the game piece on the board and into one of the cups.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new game apparatus and method which has many of the advantages of the games mentioned heretofore and many novel features that result in a new game which is not anticipated, rendered obvious, suggested, or even implied by any of the prior art games, either alone or in any combination thereof.

It is another object of the present invention to provide a new game which may be easily and efficiently manufactured and marketed.

It is a further object of the present invention to provide a new game which is of a durable and reliable construction.

An even further object of the present invention is to provide a new game which is susceptible of a low cost of manufacture with regard to both materials and labor, and which accordingly is then susceptible of low prices of sale to the consuming public, thereby making such game economically available to the buying public.

Still yet another object of the present invention is to provide a new game which provides in the apparatuses and methods of the prior art some of the advantages thereof, while simultaneously overcoming some of the disadvantages normally associated therewith.

Still another object of the present invention is to provide a new game for attempting to bounce a game piece into one of a plurality of cups.

Yet another object of the present invention is to provide a new game which includes a game board having a top surface, a front edge, a back edge and a pair of side edges. A starting line extends between the side edges and is orientated generally parallel to the front edge. The starting line is positioned nearer the front edge than the back edge. A plurality of cups is positioned on the game board. A first and second of the cups is positioned generally between the starting line and the back edge. A third of the cups is positioned generally between the first and second cups and the front edge. A fourth and fifth of the cups is positioned between front edge and the third cup. A sixth of the cups is positioned between the fourth and fifth cups and the back edge. A game piece is elongated and has a pointed end. Players attempt the game piece on the board and into one of the cups.

Still yet another object of the present invention is to provide a new game that is a game that may be played by all ages and has game pieces that may be replaced with pencils.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
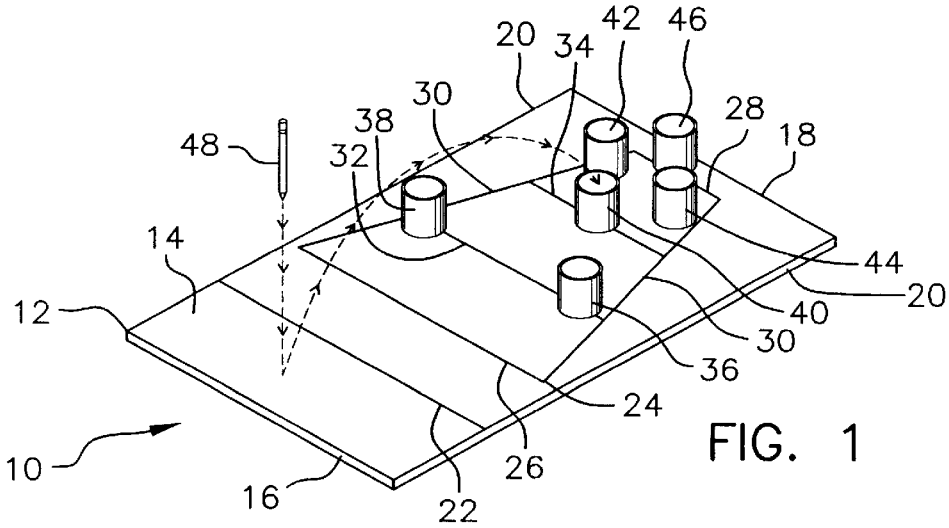
FIG. 1 is a schematic perspective view of the first embodiment of a new game according to the present invention.
Figure 2:
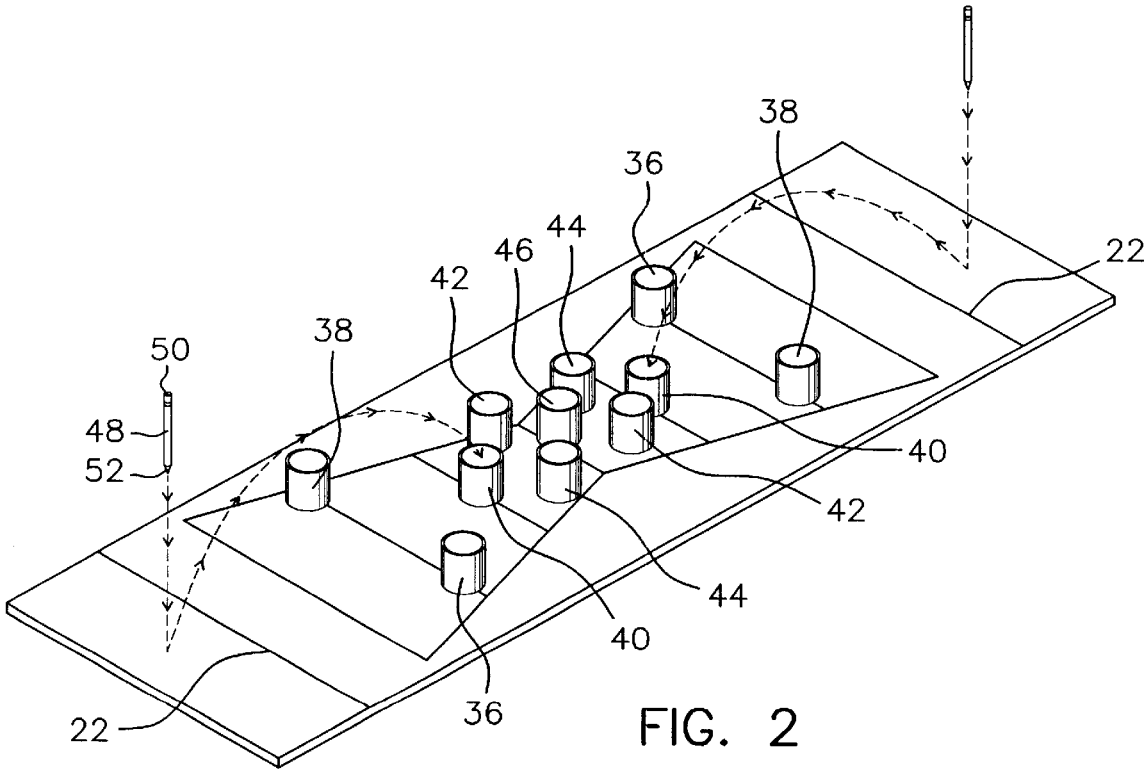
FIG. 2 is a schematic perspective view of the second embodiment of the present invention.

With reference now to the drawings, and in particular to FIGS. 1 and 2 thereof, a new game embodying the principles and concepts of the present invention and generally designated by the reference numeral 10 will be described.

As best illustrated in FIGS. 1, the game 10 generally comprises a game board 12 having a top surface 14, a front edge 16, a back edge 18 and a pair of side edges 20. A starting line 22 extends between the side edges and is orientated generally parallel to the front edge. The starting line 22 is positioned nearer the front edge 16 than the back edge 18. A trapezoid 24 is positioned on the game board and is located between the starting line 22 and the front edge 16. The trapezoid 24 has a first base 26, a second base 28 and a pair of legs 30. The second base 28 is positioned generally adjacent to the back edge 18 and has a length less than one-half a length of the first base 26. A first line 32 and a second line 34 extend between the legs 30 of the trapezoid and each is oriented parallel to the first base 26. A distance from the first base 26 to the first line 32 is equal to a distance from the first line 32 to the second line 34 and the second line 34 to the second base 28. The front 16 and back edges 18 have a length preferably between 3 inches and 5 inches. The side edges 20 has a length preferably between 12 inches and 15 inches.

A plurality of cups are positioned on the game board. A first 36 and second of the cups 38 are positioned on the first line 32. Each of the first 36 and second cups 38 is spaced from each other and each is generally adjacent to one of the legs 30. A third 40 of the cups is positioned on the second line 34. A fourth 42 and fifth 44 of the cups are positioned between the second line 34 and the second base 28. Each of the fourth 42 and fifth 44 cups is spaced from each other and each is generally adjacent to one of the legs 30. A sixth 46 of the cups is positioned on the second base.

A game piece 48 is elongated and has a first end 50 and a second end 52. The first end 50 has a blunted shape and the second end 52 is pointed. Preferably, the game piece 48 comprises an elastomeric material.

FIG. 2 shows a second embodiment whereby two game boards 12 are integrally coupled at their back edges 18. Each game board 12 has its own first 36 through fifth 44 cups and the game boards share the sixth cup 46.

Rules of the Game

The game piece 48 is dropped between the starting line 22 and the front edge 16 of the game board 12 such that the second end 52 of the game piece 48 strikes the game board 12 and the game piece 48 bounces toward the cups. Players take turns dropping the game piece. Each turn comprises dropping the game piece once.

Player acquire points when the game piece bounces over the starting line and into one of the cups. 20 points are acquired when the game piece lands in the first 36 or second 38 cup. 30 points are acquired when the game piece lands in the third cup 40. 40 points are acquired when the game piece lands in the fourth 42 or fifth 44 cup. 50 points are acquired when the game piece lands in the sixth cup 46.

The player first accumulating a predetermined amount of points wins the game. The points needed may be chosen depending on skills of the players and amount of time available to play.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a game comprising the steps of:

providing a game board, said game board having a top surface and having a front edge, a back edge and a pair of side edges, a starting line extending between said side edges and being orientated generally parallel to said front edge, said starting line being positioned nearer said front edge than said back edge;

providing a plurality of cups, a first and second of said cups being positioned generally between said starting line and said back edge, a third of said cups being positioned generally between said first and second cups and said back edge, a fourth and fifth of said cups being positioned between said back edge and said third cup, a sixth of said cups being positioned between said fourth and fifth cups and said back edge;

providing a game piece, said game piece being elongated and having a pointed end;

providing a plurality of players;

dropping said game piece between said starting line and said front edge of said game board such that said pointed end of said game piece strikes said game board and said game piece bounces toward said cups;

acquiring points when said game piece bounces over said starting line and into one of said cups; and winning the game by a player who first accumulates a predetermined amount of points.

2. The method of playing a game as in claim 1, wherein said step of providing a game board further includes:

a trapezoid being positioned on said game board and located between said starting line and said front edge, said trapezoid having a first base, a second base and a pair of legs, said second base being positioned generally adjacent to said back edge and having a length less than one-half a length of said first base, a first line and a second line extending between said legs of said trapezoid and each being oriented parallel to said first base, a distance from said first base to said first line being equal to a distance from said first line to said second line and said second line to said second base; and said first and second of said cups being positioned on said first line, each of said first and second cups being spaced from each other and each being generally adjacent to one of said legs, said third cup being positioned on said second line, said fourth and fifth of said cups being positioned between said second line and said second base, said fourth and fifth of said cups being spaced from each other and each being generally adjacent to one of said legs, said sixth cup being positioned on said second base.

3. The method of playing a game as in claim 2, wherein said front and back edges having a length generally between 3 inches and 5 inches, said side edges having a length generally between 12 inches and 15 inches.

4. The method of playing a game as in claim 1, wherein said front and back edges having a length generally between 3 inches and 5 inches, said side edges having a length generally between 12 inches and 15 inches.

5. The method of playing a game as in claim 1, wherein said game piece comprises an elastomeric material.

6. The method of playing a game as in claim 1, wherein the step of acquiring points includes 20 points being acquired when said game piece lands in said first or second cup, 30 points being acquired when said game piece lands in said third cup, 40 points being acquired when said game piece lands in said fourth or fifth cup, 50 points being acquired when said game piece lands in said sixth cup.

7. The method of playing a game as in claim 1, wherein a pair of game boards are integrally coupled together at their respective back edges, each of said game boards having a first through fifth cup, said game boards sharing said sixth cup.

8. A method of playing a game comprising the steps of:

providing a game board, said game board having a top surface and having a front edge, a back edge and a pair of side edges, a starting line extending between said side edges and being orientated generally parallel to said front edge, said starting line being positioned nearer said front edge than said back edge, a trapezoid being positioned on said game board and located between said starting line and said front edge, said trapezoid having a first base, a second base and a pair of legs, said second base being positioned generally adjacent to said back edge and having a length less than one-half a length of said first base, a first line and a second line extending between said legs of said trapezoid and each being oriented parallel to said first base, a distance from said first base to said first line being equal to a distance from said first line to said second line and said second line to said second base, said front and back edges having a length generally between 3 inches and 5 inches, said side edges having a length generally between 12 inches and 15 inches;

providing a plurality of cups, a first and second of said cups being positioned on said first line, each of said first and second cups being spaced from each other and each being generally adjacent to one of said legs, a third of said cups being positioned on said second line, a fourth and fifth of said cups being positioned between said second line and said second base, said fourth and fifth of said cups being spaced from each other and each being generally adjacent to one of said legs, a sixth of said cups being positioned on said second base;

providing a game piece, said game piece being elongated and having a first end and a second end, said first end having a blunted shape, said second end being pointed, said game piece comprising an elastomeric material;

providing a plurality of players;

dropping said game piece between said starting line and said front edge of said game board such that said second end of said game piece strikes said game board and said game piece bounces toward said cups, said players taking turns dropping said game piece, wherein each of said players are allowed one dropping of said game piece per turn;

acquiring points when said game piece bounces over said starting line and into one of said cups, 20 points being acquired when said game piece lands in said first or second cup, 30 points being acquired when said game piece lands in said third cup, 40 points being acquired when said game piece lands in said fourth or fifth cup, 50 points being acquired when said game piece lands in said sixth cup; and winning the game by a player who first accumulates a predetermined amount of points.

9. A game comprising:

a game board having a top surface and having a front edge, a back edge and a pair of side edges, a starting line extending between said side edges and being orientated generally parallel to said front edge, said starting line being positioned nearer said front edge than said back edge, a trapezoid being positioned on said game board and located between said starting line and said front edge, said trapezoid having a first base, a second base and a pair of legs, said second base being positioned generally adjacent to said back edge and having a length less than one-half a length of said first base, a first line and a second line extending between said legs of said trapezoid and each being oriented parallel to said first base, a distance from said first base to said first line being equal to a distance from said first line to said second line and said second line to said second base;

a plurality of cups, a first and second of said cups being positioned on said first line, each of said first and second cups being spaced from each other and each being generally adjacent to one of said legs, a third of said cups being positioned on said second line, a fourth and fifth of said cups being positioned between said second line and said second base, said fourth and fifth of said cups being spaced from each other and each being generally adjacent to one of said legs, a sixth of said cups being positioned on said second base; and a game piece, said game piece being elongated and having a first end and a second end, said first end having a blunted shape, said second end being pointed.

* * * * *